United States Patent [19]

Schranz et al.

[11] Patent Number: 4,770,970

[45] Date of Patent: Sep. 13, 1988

[54] PHOTOGRAPHIC HEAT DEVELOPMENT PROCESS AND AUXILIARY SHEET SUITABLE THEREIN

[75] Inventors: Karl-Wilhelm Schranz, Odenthal-Hahnenberg; Günther Schenk, Cologne, both of Fed. Rep. of Germany

[73] Assignee: Agfa-Gevaert AG, Leverkusen, Fed. Rep. of Germany

[21] Appl. No.: 875,569

[22] Filed: Jun. 18, 1986

[30] Foreign Application Priority Data

Jun. 29, 1985 [DE] Fed. Rep. of Germany ..... 352361

[51] Int. Cl.[4] ..... G03C 5/54

[52] U.S. Cl. ..... 430/138; 430/203; 430/206; 430/218

[58] Field of Search ..... 430/203, 206, 138

[56] References Cited

U.S. PATENT DOCUMENTS

| | | | |
|---|---|---|---|
| T878,008 | 9/1970 | Padday . | |
| 3,386,824 | 6/1968 | Miller et al. | 430/138 |
| 4,124,387 | 11/1978 | Kohrt | 430/203 |
| 4,235,957 | 11/1980 | Kohrt et al. | 430/203 |
| 4,500,624 | 2/1985 | Aono et al. | 430/203 |
| 4,500,626 | 2/1985 | Naito et al. | 430/203 |

FOREIGN PATENT DOCUMENTS

| | | | |
|---|---|---|---|
| 0123904 | 7/1984 | European Pat. Off. . | |
| 1175988 | 8/1964 | Fed. Rep. of Germany . | |
| 2003605 | 11/1969 | France . | |
| 0014241 | 1/1985 | Japan | 430/203 |
| 268862 | 7/1962 | Netherlands . | |
| 1121277 | 7/1968 | United Kingdom . | |

OTHER PUBLICATIONS

Chem. Abstracts No. 158123b, "Diffusion Transfer . . . Processes", vol. 102, 1985.

*Primary Examiner*—Richard L. Schilling
*Attorney, Agent, or Firm*—Connolly & Hutz

[57] ABSTRACT

The heat development process using an integral color photographic recording material carrying, on a preferably transparent layer support, both an image receptor layer and light-sensitive layers of binder with silver halide and associated dye releasing compounds, optionally with a light-reflecting layer of pigment between the image receptor layer and the light-sensitive layers, may be carried out as a one-step development process in which silver halide development and color transfer take place at the same time if an auxiliary sheet containing a thermal development and diffusion promoting substance in a layer of binder is used. The thermal development and diffusion promoting agent is preferably liquid under normal conditions and dispersed in a microencapsulated form in the layer of binder.

4 Claims, No Drawings

PHOTOGRAPHIC HEAT DEVELOPMENT PROCESS AND AUXILIARY SHEET SUITABLE THEREIN

This invention relates to a heat development process in which a colour photographic recording material carrying, on a common layer support, a laminate consisting of an image receptor layer and a light-sensitive part comprising at least one light-sensitive layer of binder containing silver halide and at least one associated colour producing compound is heated in contact with an auxiliary sheet after imagewise exposure, the said sheet containing a thermal development and diffusion promoting agent dispersed in a layer of binder.

It is known that colour images can be produced by heat treatment of suitable colour photographic recording materials. Colour producing compounds particularly suitable for this purpose are of the kind which can be incorporated in a non-diffusible form in the layer of a photographic recording material and are capable of releasing diffusible dye as a result of development (dye releasing compounds).

The particular suitability of such dye releasing compounds is due to the fact that the dyes which are released imagewise can be transferred to separate image receptor layers to form a brilliant colour image which is not impaired by image silver or silver halide and therefore requires no after-treatment. The combination of heat development process with the dye diffusion process thus provides an advantageous rapid process for the production of colour images. A recording material suitable for this purpose has been described, for example, in DE-A-No. 3 215 485.

According to the above mentioned publication, a recording material having a layer containing a combination of silver halide, silver benzotriazole, a dye releasing compound and guanidine trichloroacetate (base donor) is exposed imagewise and then subjected to a heat treatment in contact with an image receptor sheet so that the dye which has been released imagewise is transferred to the receptor sheet. The production of multicoloured images requires several such combinations and the silver halide in each of these combinations is sensitive to a different spectral region of light and is associated with a dye releasing compound conforming to its particular spectral sensitivity. This dye releasing compound releases a dye of a different colour, in most cases a colour which is complementary to the colour of light to which the particular silver halide is predominantly sensitive. Such associations may be arranged one above the other in different layers.

In order to ensure rapid and complete development, including the process of dye diffusion, it is necessary to provide a sufficient quantity of water or some other hydrophilic medium. This is generally achieved by leaving the recording material containing the one or more than one light-sensitive layer or the image receptor sheet or both to swell in water before they are brought into contact with each other and heated. The conventional methods of moistening the material are complicated and time consuming, especially as they must be followed by careful drying to remove excess moisture. These disadvantages are even more pronounced when the image receptor layer and the light-sensitive layers are arranged on a common layer support to form an integral photothermographic recording material since the number of layers on a support and the overall thickness are then greater.

It is also known to incorporate the moisture required as transfer solvent into the photographic recording material in the form of water of crystallisation or in a micro-encapsulated form. If, however, the image receptor layer and the light-sensitive layers form an integral recording material, this method gives rise to particular difficulties, either because imagewise exposure or dye diffusion is impaired due to the size of the microcapsules, and the extent of this problem will vary according to the arrangement of the microcapsules in the recording material, or because water used in the form of water of crystallisation is liable to be released prematurely, thereby impairing the stability of the recording material.

It is an object of the present invention to provide a simplified heat development process by which dry images with intensive colour can be obtained within a very short time, using an integral photothermographic recording material containing, on a common layer support, both the image receptor layer and the light-sensitive layers, and in particular avoiding the use of liquid baths and hence also avoiding the need for prolonged drying as after-treatment.

The present invention relates to a heat development process for the production of colour images in which a colour photographic recording material which has been exposed imagewise is developed by heat treatment in the presence of a thermal development and diffusion promoting agent. This recording material is formed by a layer support on which is arranged a laminate composed of at least one image receptor layer capable of being coloured by diffusible dyes and at least one layer of binder containing light-sensitive silver halide, optionally in combination with a substantially light-insensitive silver salt, and associated with a non-diffusible colour producing compound capable of releasing a diffusible dye as a result of development. This process is characterised in that the heat treatment is carried out while the colour photographic recording material is placed with its active side in flat contact with an auxiliary sheet containing at least one thermal development and diffusion promoting agent dispersed in a layer of binder.

The process according to the invention thus uses an auxiliary sheet containing a dispersion of at least one thermal development and diffusion promoting agent in a layer of binder in a quantity sufficient to provide a suitable medium for development and diffusion in the colour photographic material when heated. To provide this medium, the exposed recording material which carries, on a preferably transparent layer support, both an image receptor layer and at least one light-sensitive layer with the necessary light-sensitive substances and the associated colour producing compounds, is brought with its coated side in flat contact with the auxiliary sheet and heated. The heat causes the development and diffusion promoting agent to be transferred from the auxiliary sheet to the layers of recording material so that the development and diffusion processes can take place therein.

The layer support for the auxiliary sheet used according to the invention may be either transparent or opaque, as desired. Layer supports of polyethylene terephthalate (polyester), for example, are suitable. The layer support carries a layer of binder in which the thermal development and diffusion promoting agent is dispersed.

Compounds suitable as thermal development and diffusion promoting agents according to the present invention include, for example, those described as so-called thermal solvents in the literature on heat development processes. These thermal solvents are generally understood to be organic compounds which are not capable of being hydrolysed and are solid under normal conditions but melt when heated to the temperature of the heat treatment to form a liquid medium in which the development processes can take place more rapidly. Such thermal solvents may act, for example, as diffusion accelerators. Preferred examples of thermal solvents include polyglycols described, for example, in U.S. Pat. No. 3,347,675, e.g. polyethylene glycol with an average molecular weight of from 1500 to 20,000, derivatives of polyethylene oxide, e.g. the oleic acid esters thereof, beeswax, monostearin, compounds with a high dielectric constant containing a —$SO_2$— or —CO— group, such as acetamide, lactams, succinamide, ethyl carbamate, urea, methylsulphonamide and ethylene carbonate; also polar substances as described in U.S. Pat. No. 3,667,959, the lactone of 4-hydroxybutanic acid or of 4-hydrobutyric acid, dimethylsulphoxide, tetrahydrothiophene-1,1-dioxide, 1,10-decanediol, methyl anisate, biphenylsuberate, etc. The hydrophilic thermal solvents described in EP-A- No.0 119 615 are particular heterocyclic compounds containing nitrogen or compounds having at least one —CO—, —$SO_2$—, —N→O or —OH group. These groups thus constitute characteristic structural features of the development and diffusion promoting agents used according to the invention, the groups —CO— and —$SO_2$—in particular being present within one of the following groups: —CO—O—, —CO—N<, —O—CO—O—, —O—CO—N<, >N—CO—N<, —$SO_2$—N<, >N—$SO_2$—N<.

The thermal development and diffusion promoting agents used according to the invention are, however, by no means limited to the thermal solvents hitherto known, i.e. to compounds which are solid under normal conditions and become liquid only when heated to the temperature of the heat treatment. According to the invention it is in fact preferred to use compounds which are already liquid under normal conditions, but these compounds should also have a hydrophilic character. The last mentioned compounds which are liquid under normal conditions are distinguished by their high dielectric constant as well as structurally by the presence of —$SO_2$— or —CO— groups and most preferably —OH— groups. Water, ethylene glycol, glycerol and other efficient solubilizing solvents constitute suitable examples of such thermal development and diffusion promoting agents according to the invention which are liquid under normal conditions.

The thermal development and diffusion promoting agents are dispersed in the layer of binder of the auxiliary sheet according to the invention. If the compounds used are solid under normal conditions, they may be dispersed by the usual methods. For example, the thermal development and diffusion promoting agents may be added to the solution or dispersion (casting solution) of a binder in the form of a solution or dispersion in a readily removable solvent. Suitable methods for this procedure are well known to the man of the art. It is particularly when the thermal development and diffusion promoting agent according to the invention is a compound which is liquid under normal conditions that it is preferred to employ a method of incorporation in which the said compound is enveloped in small capsules (microcapsules) of a polymeric material before being added to the binder and dispersed therein.

When this method is employed, an auxiliary sheet according to the invention prepared from such liquids will have a dry and solid feel under normal conditions and yet be capable of releasing the required compounds when heated to the temperature of thermal development, the compounds being released by any of various methods, e.g. by melting of the material of the capsule or bursting the capsule wall or by thermal diffusion through the wall of the capsules. Methods of encapsulating liquids (microencapsulation) are well known to the man of the art. Information on this subject may be found, for example, in the monograph "Microcapsule Processing and Technology" by A. Kondo, Marcel Dekker Inc. New York and Basle.

Examples of substances which may be used in an encapsulated form as liquid thermal development and diffusion promoting agents according to the invention include water, glycerol and mixtures thereof, but glycerol may be partly or completely replaced by other good solubilizing solvents. Polystyrene, for example, is a suitable material for the capsules. The water may also be added to the layer of binder of the auxiliary sheet in the form of water of crystallisation. In that case, encapsulation is unnecessary. The same applies to other hydrophilic liquids which may be bound as ligands in the crystal lattice of crystallizing substances.

The quantity of thermal development and diffusion promoting agent in the auxiliary sheet depends, of course, on the number and thickness of the layers in the recording materials used, and the most suitable quantity can be determined in each case by a test series. It is generally sufficient to provide from 1 to 4 g/$m^2$ of thermal development and diffusion promoting agent in the auxiliary sheet.

The binder in the auxiliary sheet as also that used in the layers of the colour photographic recording material may be either hydrophobic or hydrophilic although hydrophilic binders are preferred. Gelatine is used for preference, but this may be partly or completely replaced by other natural or synthetic binders. Examples of natural binders include alginic acid and its derivatives, such as its salts, esters and amides. Cellulose derivatives such as carboxymethylcellulose, alkyl celluloses such as hydroxyethylcellulose, starch and its derivatives, and carrageenates. Polyvinyl alcohol, partly saponified polyvinyl acetate and polyvinyl pyrrolidone are examples of suitable synthetic binders.

Examples of hydrophobic binders include polymers of polymerisable, ethylenically unsaturated monomers such as alkyl acrylates, alkyl methacrylates, styrene, vinyl chloride, vinyl acetate, acrylonitrile and acrylamides. Such polymers may be used, for example, in latex form.

Apart from the thermal development and diffusion promoting agents according to the invention, the auxiliary sheets may contain other auxiliary substances which also assist the development processes taking place during the heat treatment, these additional substances being preferably present in the layer of binder which also contains the thermal development and diffusion promoting agents.

These additional substances are mainly electron transfer agents and base donors. Auxiliary substances of this kind may also be present at least in part in the colour photographic recording material and will therefore be described in detail below in the description of the colour photographic recording material. Suitable base donors are, for example, compounds of the type of sodium benzotriazolate, which crystallise as complexes with varying quantities of water (up to 24 mol $H_2O$). They have been described in U.S. Pat. No. 4,418,139, but only as $H_2O$ donors. The alkali metal salts of other organic compounds with a similarly high $pK_a$-value are also suitable as base donors. In the auxiliary sheet, the layer of binder which according to the invention contains the development and diffusion promoting agents and optionally other auxiliary substances, may be covered by a protective layer in the form of another hardened layer binder, e.g. a hardened gelatine layer.

The colour photographic recording material used in the process according to the invention is of the integral type, i.e. it contains both the image receptor layer and the light-sensitive layers on a common layer support. The laminate of the above mentioned layers is preferably so arranged on the layer support that the image receptor layer is close to the layer support and the light-sensitive layers are remote from the layer support.

In the process according to the invention, therefore, the image receptor layer is arranged on the same layer support as the light-sensitive element (single sheet material). It consists mainly of a binder containing mordant for fixing the diffusible dyes which are released from the non-diffusible dye releasing compounds. The mordants for anionic dyes are preferably long chained quaternary ammonium or phosphonium compounds, e.g. those described in U.S. Pat. No. 3,271,147 and U.S. Pat. No. 3,271,148.

Certain metal salts and their hydroxides which form sparingly soluble compounds with the acid dyes may also be used. Polymeric mordants such as those described in DE-A-No. 2 315 304, DE-A-No. 2 631 521 and DE-A-No. 2 941 818 may also be suitable. The dye mordants in the mordant layer are dispersed in one of the usual hydrophilic binders, e.g. in gelatine, polyvinyl pyrrolidone or partly or completely hydrolysed cellulose ester. Some binders may, of course, function as mordants, e.g. the polymers of nitrogen-containing bases, including quaternary bases of this kind, such as N-methyl-4-vinyl pyridine, 4-vinyl pyridine or 1-vinyl imidazole, as described, for example, in U.S. Pat. No. 2,484,430. Guanylhydrazone derivatives of alkyl vinyl ketone polymers as described, for example, in U.S. Pat. No. 2,882,156 and guanylhydrazone derivatives of acyl styrene polymers as described, for example, in DE-A-No. 2,009,498 are further examples of suitable mordanting binders but the last mentioned mordanting binders would generally be used in conjunction with other binders, e.g. gelatine.

The light-sensitive part of the colour photographic recording material used in the heat development process according to the invention comprises at least one layer of binder which contains a light-sensitive silver halide, optionally in combination with a substantially light-insensitive silver salt and is associated with a non-diffusible colour producing compound capable of giving rise to a diffusible dye by heat development.

The light-sensitive silver halide may consist of silver chloride, silver bromide, silver iodide or mixtures thereof and have a particle size of from 0.02 to 2.0 μm, preferably from 0.1 to 1.0 μm. It may be present in the form of non-sensitized silver halide or it may be chemically and/or spectrally sensitized by suitable additives.

The quantity of light-sensitive silver halide may amount to 0.01 to 2.0 g per $m^2$ in the given layer but in some embodiments the quantity would be mainly in the lower region of this range owing to the catalytic function of the silver halide (as exposed silver halide).

The substantially light-insensitive silver salt may consist of a salt which is comparatively stable to light, e.g. an organic silver salt. Suitable examples of such salts include the silver salts of aliphatic and aromatic carboxylic acids and the silver salts of heterocyclic compounds containing nitrogen as well as silver salts of organic mercapto compounds.

Preferred examples of silver salts of aliphatic carboxylic acids include silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate and silver butyrate. The carboxylic acids of these silver salts may be substituted, for example, with halogen atoms, hydroxyl groups or thioether groups.

Examples of silver salts of aromatic carboxylic acids and other compounds containing carboxyl groups include silver benzoate, silver-3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenyl acetate, silver pyromellitate, silver salts of 3-carboxymethyl-methyl-4-methyl-4-thiazoline-2-thione and similar heterocyclic compounds. Silver salts of organic mercaptans are also suitable, e.g. the silver salts of 3-mercapto-4-phenyl-1,2,4-triazole, 2-mercaptobenzimidazole, 2-mercaptobenzothiazole, 2-mercaptobenzoxazole, 2-mercaptooxadiazole, mercaptotriazine and thioglycollic acid and the silver salts of dithiocarboxylic acids, e.g. the silver salt of dithioacetate.

Silver salts of compounds containing an imino group are also suitable. Preferred examples of such compounds include the silver salts of benzotriazole and its derivatives, e.g. silver salts of alkyl- and/or halogen-substituted benzotriazoles, such as the silver salts of methyl benzotriazole and of 5-chlorobenzothiazole, the silver salts of 1,2,4-triazole, 1-H-tetrazole, carbazole and saccharine, and the silver salts of imidazole and benzimidazole and derivatives thereof.

The quantity of the substantially light-insensitive silver salt included in the layer according to the present invention amounts to 0.05 to 5 g per $m^2$. The substantially light-insensitive silver salt and the light-sensitive silver halide may be present side by side in the form of separate particles or they may be present in a combined form which may be produced, for example, by treating a substantially light-insensitive silver salt in the presence of halide ions so that light-sensitive centres of light-sensitive silver halide form on the surface of the particles of the substantially light-insensitive silver salt by a double reaction (conversion); see U.S. Pat. No. 3,457,075.

The substantially light-insensitive silver salt serves as a reservoir of metal ions which are reduced to elementary silver under the catalytic influence of the imagewise exposed silver halide when heat development is carried out in the presence of a reducing agent, and thus serve as oxidizing agents (for the reducing agent present).

The light-sensitive part of the recording material used in the heat development process according to the invention also contains a non-diffusible, colour producing compound which is capable of releasing a diffusible dye by a redox reaction taking place in the course of development. This compound will hereinafter be referred to as dye releasing compound.

The dye releasing compounds used according to the invention may be any of numerous types of compounds which are all distinguished by a linking member which is redox dependent for the strength of its linkage and links a dye residue to a carrier group which contains a ballast group.

In this connection, reference may be made to a summarizing report of this field in Angew. Chem. Int. Ed. Engl. 22 (1983), 191–209, in which the most important of the known systems are described.

Redox active dye releasing compounds corresponding to the formula

BALLAST-REDOX-DYE are found to be particularly advantageous for this purpose.

In the above formula

BALLAST denotes a ballast group,

REDOX denotes a redox active group, i.e. a group which can be oxidized or reduced under the conditions of alkaline development and which, depending on whether it is present in the oxidized or the reduced state, can undergo to varying degrees an elimination reaction, a nucleophilic displacement reaction, hydrolysis or some other decomposition reaction with the result that the DYE residue is split off, and DYE denotes the residue of a diffusible dye, e.g. a yellow, magenta or cyan dye, or the residue of a dye precursor.

The ballast groups are groups which enable the dye releasing compounds according to the invention to be incorporated in a diffusion-fast form in the hydrophilic colloids normally used in photographic materials. The groups which are particularly suitable for this purpose are organic groups generally containing straight chained or branched aliphatic groups with generally 8 to 20 carbon atoms and optionally also containing carbocyclic or heterocyclic, optionally aromatic groups. These ballast groups may be attached to the remainder of the molecule either directly or indirectly, e.g. by way of one of the following groups: —NHCO—, —NH-$SO_2$—, —NR— wherein R denotes hydrogen or alkyl, —O— or —S—. The ballast group may in addition contain water-solubilizing groups, e.g. sulpho groups or carboxyl groups, and these may also be present in an anionic form. Since the diffusion characteristics depend upon the molecular size of the whole compound used, it is sufficient in some cases, e.g. if the whole molecule is large enough, to use shorter chained groups as ballast groups.

Redox active carrier groups having the structure of BALLAST-REDOX- and corresponding dye releasing groups are known in a wide variety of forms. A detailed description is unnecessary here in view of the above-mentioned survey given in Angew. Chem. Int. Ed. Engl. 22 (1983) 191–209.

Some examples of redox active carrier groups from which a dye residue is split off as a result of imagewise oxidation or reduction are given here merely for the purpose of illustration:

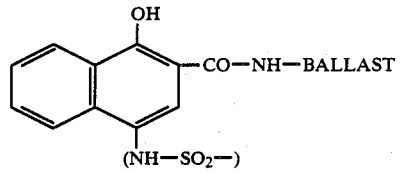

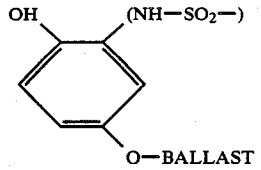

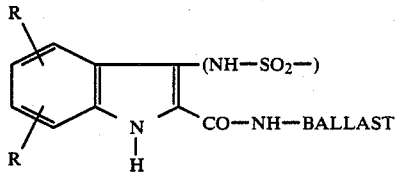

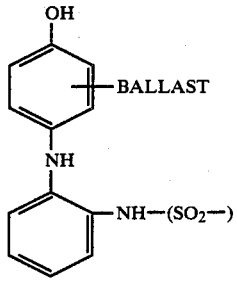

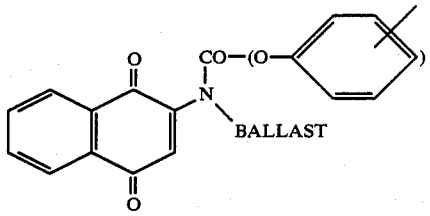

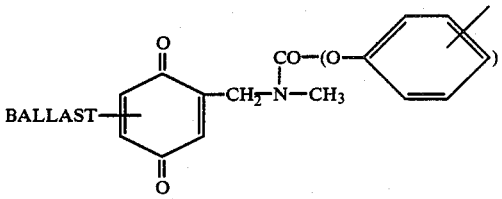

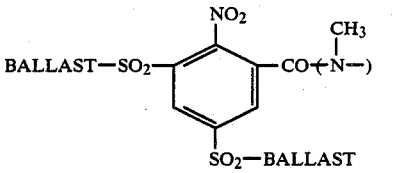

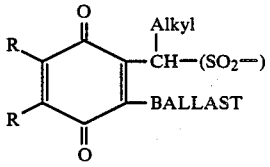

-continued

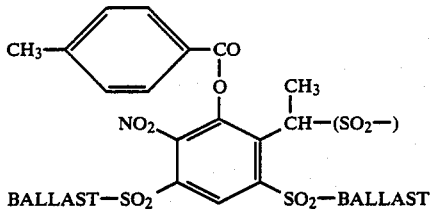

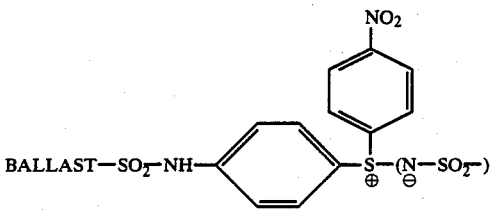

The groups in brackets are functional groups of the dye residue and are separated together with this residue from the remaining part of the carrier group. The functional group may be a substituent which may exert a direct influence on the absorption and possibly also complex forming properties of the released dye. On the other hand, the functional group may be separated from the chromophore of the dye by an intermediate or linking member. Lastly, the functional group may have some importance in conjunction with the intermediate member for the diffusion and mordanting characteristics of the released dye. Alkylene and arylene, for example, are suitable intermediate members.

The dye residues of all classes of dyes are in principle suitable as dye residues, provided they are sufficiently diffusible to be capable of diffusing into an image receptor layer from the light-sensitive layer of the light-sensitive material. For this purpose, the dye residues may carry one or more groups which confer solubility in alkalies. Suitable alkali solubilizing groups include inter alia carboxyl groups, sulpho groups, sulphonamide groups and aromatic hydroxyl groups. Such alkali solubilizing groups may already be preformed in the dye releasing compounds or they may result from the removal of the dye residue from the carrier group which carries ballast groups. The following are examples of suitable dyes: Azo dyes, azomethine dyes, anthraquinone dyes, phthalocyanine dyes, indigoid dyes and triphenylmethane dyes, including dyes which are in the form of complexes or capable of complex formation with metal ions.

The residues of dye precursors are understood to be residues of compounds which in the course of photographic processing, in particular under the conditions of heat development, are converted into dyes either by oxidation or by coupling or by complex formation or by release of an auxochromic group in a chromophoric system, for example by saponification. Dye precursors in this sense include leuco dyes, couplers and dyes which are converted into other dyes in the course of processing. The latter should also be included under the term of dye residues so long as a distinction between dye residues and residues of dye precursors is not important.

Suitable dye releasing compounds have been described, for example, in the following documents: U.S. Pat. No. 3,227,550, U.S. Pat. No. 3,443,939, U.S. Pat. No.3,443,940, DE-A-No. 1 930 215, DE-A-No. 2 242 762, DE-A-No. 2402900, DE-A-No. 2 406 664, DE-A-No. 2 505 248, DE-A-No. 2 543 902, DE-A-No. 2 613 005, DE-A-No. 2 645 656, DE.A-No. 2 809 716, DE-A-No. 2 823 159, BE-A-No. 861 241, EP-A-No. 0 004 399, EP-A-No. 0 004 400, DE-A-No. 3 008 588, DE-A-No. 3 014 669, and GB-A-No. 8 012 242.

In some embodiments of the heat development process according to the invention the dye releasing compounds may be present as oxidizable colour releasing compounds or colour releasing compounds capable of coupling, while in others they may be present as reducible dye reducing compounds. When conventional negative silver halide emulsions are used, the copy obtained from the original is either negative or positive depending on whether the dye has been released from the oxidized or the reduced form of the dye releasing compound. It is therefore possible to obtain either positive or negative images as desired by suitable choice of the dye releasing systems.

Oxidizable dye releasing compounds which are particularly suitable for the heat developable recording materials according to the invention are described, for example, in DE-A-No. 2 645 656. The following are examples of such dye releasing compounds:

Dye releasing compound 1

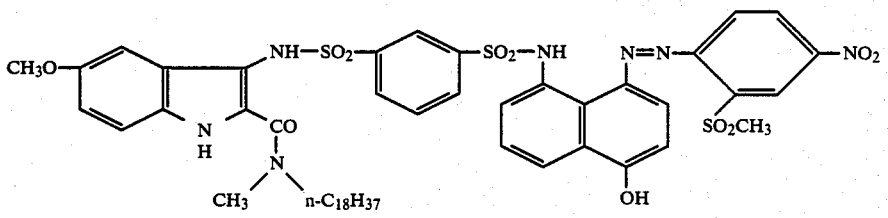

Dye releasing compound 2

-continued
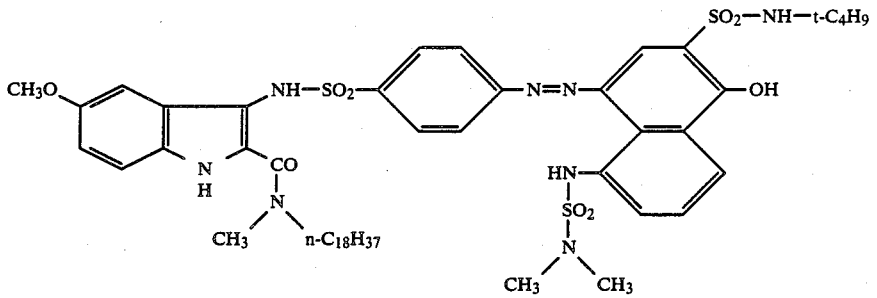
Dye releasing compound 3
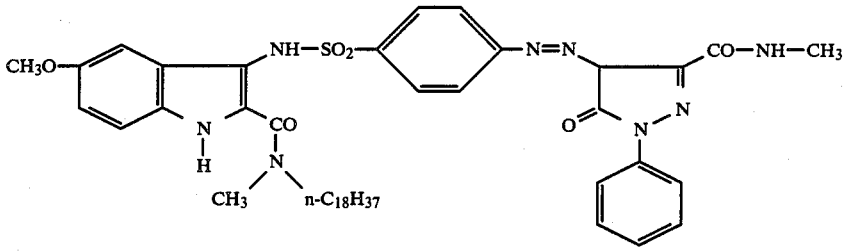
Other suitable oxidizable dye releasing compounds are described, for example, in DE-A-No. 2,242,762, DE-A-No. 2 505 248, DE-A-No. 2 613 005 and GB-A-No. 8 012 242.
The following are examples of such dye releasing compounds:
Dye releasing compound 4
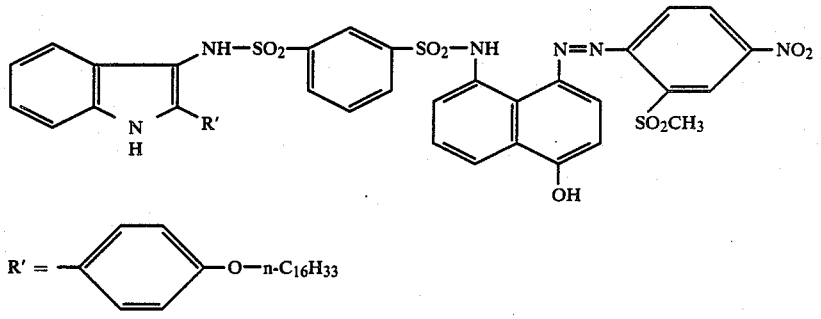
Dye releasing compound 5
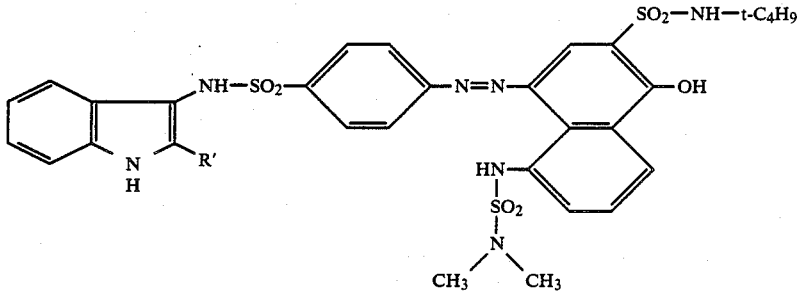
Dye releasing compound 6

-continued

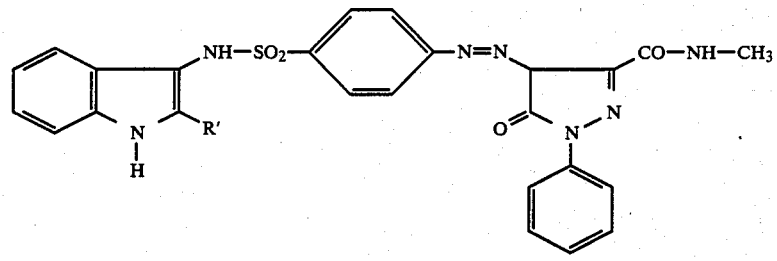

If the dye releasing compound is oxidizable, it constitutes a reducing agent which is oxidized by the imagewise exposed silver halide or by the substantially light-insensitive silver salt under the catalytic action of the imagewise exposed silver halide, either directly or indirectly with the aid of electron transfer agents ETA. This results in an imagewise differentiation in the capacity to release the diffusible dye. If, on the other hand, the dye releasing compound is reducible, then it is advantageously used in combination with a reducing agent, a so-called electron donor compound or electron donor precursor compound, which in this case is present in a limited quantity in the same layer of binder as the dye releasing compound, the light-sensitive silver halide and in some cases the substantially light insensitive silver salt. The presence of electron transfer agents may also be advantageous when reducible dye releasing compounds are used in combination with electron donor compounds.

For producing positive colour images of positive originals when negative silver halide emulsions are used, it is suitable to use, for example, a recording material according to the invention containing reducible dye releasing compounds corresponding to the following formula I

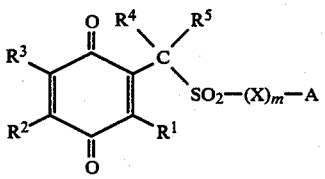

I wherein $R^1$ denotes alkyl or aryl;

$R^2$ denotes alkyl, aryl or a group which together with $R^3$ completes a condensed ring;

$R^3$ denotes hydrogen, alkyl, aryl, hydroxyl, halogen such as chlorine or bromine, amino, alkylamino or dialkylamino including cyclic amino groups (such as piperidino or morpholino), acylamino, alkylthio, alkoxy, aroxy, sulpho or a group which together with $R^2$ completes a condensed ring;

$R^4$ denotes alkyl;

$R^5$ denotes alkyl or, preferably, hydrogen;

A denotes the residue of a diffusible dye or dye precursor;

X denotes a bivalent linking member of the formula $—R—(L)_p—(R)_q—$ wherein R denotes an alkylene group having 1 to 6 carbon atoms or an optionally substituted arylene or aralkyl group and the two groups R may be identical or different;

L denotes —O—, —CO—, $—CONR^6—$, $—SO_2N-R^6—$, $—O—CO—NR^6$, —S—, —SO— or $—SO_2—$ ($R^6$=hydrogen or alkyl);

p denotes 0 or 1;

q denotes 0 or 1; and m denotes 0 or 1, and at least one of the groups $R^1$, $R^2$, $R^3$ and $R^4$ contains a ballast group.

The alkyl groups represented by $R^1$, $R^2$, $R^3$ and $R^5$ in formula I may be straight chained or branched and generally contain up to 18 carbon atoms. Examples include methyl, n-propyl, tert.-butyl, tetradecyl and octadecyl. The aryl groups represented by $R^1$, $R^2$ and $R^3$ may be, for example, phenyl groups which may be substituted, e.g. by long chained alkoxy groups.

In an acylamino group represented by $R^3$, the acyl group may be derived from aliphatic or aromatic carboxylic or sulphonic acids. The condensed rings completed by $R^2$ and $R^3$ are preferably carbocyclic rings, e.g. condensed benzene or bicyclo-[2,2,1]-heptene rings.

An alkyl group represented by $R^4$ may be straight chained or branched and substituted or unsubstituted and may contain up to 21 carbon atoms. Examples include methyl, nitromethyl, phenylmethyl(benzyl), heptyl, tridecyl, pentadecyl, heptadecyl and $—C_{21}H_{43}$.

Preferred embodiments of the dye releasing compounds used according to the invention contain $R^1$, $R^2$ and $R^3$ in a quinoidal carrier group together with not more than 8, in particular not more than 5 carbon atoms, and $R^4$ stands for an alkyl group containing at least 11 carbon atoms.

Embodiments in which $R^1$ denotes an alkoxyphenyl group with at least 12 carbon atoms in the alkoxy group and $R^2$, $R^3$ and $R^4$ together contain not more than 8 carbon atoms are also preferred.

In these dye releasing compounds, a removable, diffusion resistance conferring quinoidal carrier group corresponding to the following formula is attached to the dye residue:

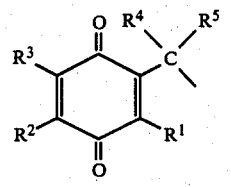

"Carquin"

In the above formula, $R^1$, $R^2$, $R^3$, $R^4$ and $R^5$ have the meanings indicated for formula II.

Such reducible dye releasing compounds and others which are also suitable for the purpose of the present invention are described, for example, in DE-A-No. 2 809 716, EP-A-No. 0 004 399, DE-A-No. 3 008 588 and DE-A-No. 3 014 669. The following are examples of such compounds:
Dye releasing compound 7
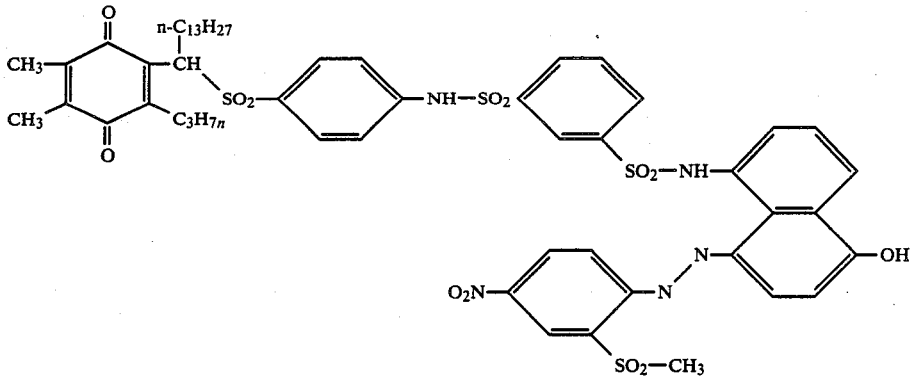
Dye releasing compound 8
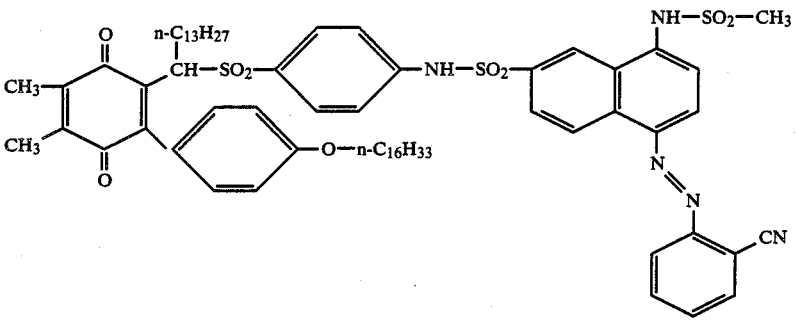
Dye releasing compound 9
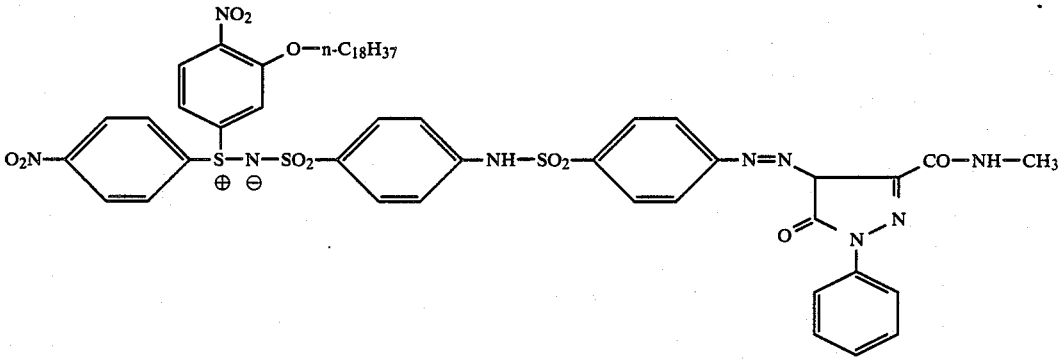
Dye releasing compound 10
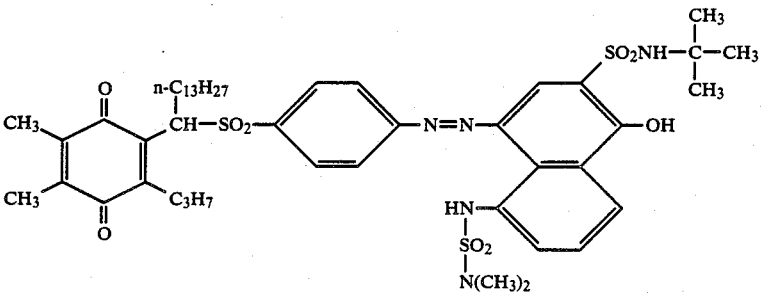
Dye releasing compound 11

-continued

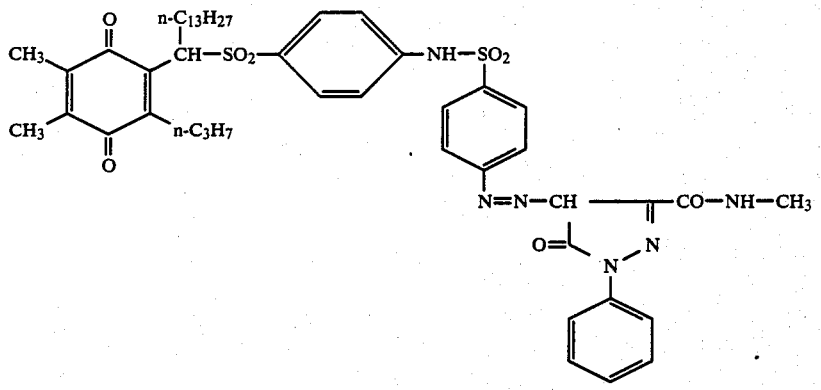

The electron donor compound used in combination with a reducible dye releasing compound serves as reducing agent both for the silver halide and the substantially light-insensitive silver salt and for the dye releasing compound. Due to the fact that the substantially light-insensitive silver salt and the dye releasing compound compete with each other in the oxidation of the electron donor compound but the light-insensitive silver salt is superior in this respect to the dye releasing compound, at least in the presence of exposed silver halide, the silver halide present will determine the regions of image in which the dye releasing compound is reduced by the electron donor compound in dependence upon the previous imagewise exposure.

Under the conditions of development, in the present case when the imagewise exposed colour photographic material is heated in contact with the auxiliary sheet used according to the invention, the limited quantity of electron donor compound present is oxidized by the substantially light-insensitive silver salt and by the light-sensitive silver halide under the catalytic action of the latent image nuclei produced by exposure in the silver halide, this oxidation taking place to an extent depending on the degree of exposure, and the electron donor compound is then no longer available for a reaction with the dye releasing compound. This results in an imagewise distribution of unused electron donor compound.

The reaction between electron donor compound and dye releasing compound necessary for releasing the diffusible dyes is, of course, only able to take place where the electron donor compound has not previously been used up by other reactions, e.g. in the present case by imagewise oxidation by the substantially light-insensitive silver salt. An important precondition for the image producing mechanism in this embodiment of the present invention is therefore a suitably graded reactivity of those components which potentially take part in a reaction with the reducing agent in the layer, namely with the electron donor compound. The components in question consist of 1. the substantially light-insensitive silver salt or silver halide in the absence of latent image nuclei,
2. the substantially light-insensitive silver salt or silver halide in the presence of latent image nuclei, and
3. the dye releasing compound.

It is found to be extremely advantageous that under the conditions of heat development the above-mentioned components have the desired graded reactivity in their reaction with the electron donor compound and that the reducing capacity of the electron donor compound is such that the substantially light-insensitive silver salt undergoes virtually no reduction by the said compound in the absence of latent image nuclei but is comparatively rapidly reduced in the presence of latent image nuclei while the dye releasing compound is reduced comparatively slowly by the electron donor compound but more rapidly than the substantially light-insensitive metal salt (in the absence of latent image nuclei).

Compounds which have been described as electron donor compounds (DE-A-No. 2 809 716) include non-diffusible or only slightly diffusible derivatives of hydroquinone, of benzisoxazolone, of p-aminophenol and of ascorbic acid (e.g. ascorbyl palmitate).

Other examples of electron donor compounds have been described in DE-A-No. 2 947 425, DE-A-No. 3 006 268, DE-A-No. 3 130 842, DE-A-No. 3 144 037, DE-A-No. 3 217 877 and EP-A-No. 0 124 915. It has been shown that the above-mentioned electron donor compounds satisfy the requirements under the conditions of heat development and are therefore also suitable electron donor compounds for the purpose of the present invention. Electron donor compounds which are not formed from the corresponding electron donor precursor compounds until they are subjected to the conditions of heat development in the layer are particularly suitable, i.e. electron donor compounds which prior to development are present in the recording material in a masked form in which they are virtually inert. These electron donor compounds, which are initially inactive, are converted into their active form under the conditions of heat development, for example by the hydrolytic removal of certain protective groups.

In the present case, the above mentioned electron donor precursor compounds are also regarded as electron donor compounds. A compound corresponding to the following formula is an example of a suitable electron donor compound:

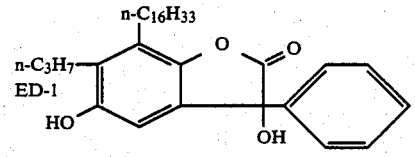

The above mentioned main constituents of the recording material used in the process according to the invention, namely the light-sensitive silver halide, the substantially light-insensitive, reducible silver salt optionally used and the dye releasing compound, optionally in combination with an electron donor compound, exist side by side, dispersed in a binder. As in the auxiliary sheet according to the invention, this binder may be either hydrophobic or hydrophilic although hydrophilic binders are preferred and gelatine is preferably used but may be partly or completely replaced by other natural or synthetic binders.

For the production of monochrome colour images, the light-sensitive layer of binder contains, in association with the light-sensitive silver halide and optionally light-insensitive silver salt, one or more dye releasing compounds from which the dyes of a certain colour are released. The colour finally obtained may be the result of mixing several dyes. It is therefore also possible to produce black-and-white images by using a carefully adjusted mixture of several dye releasing compounds of different colours. For producing polychrome colour images, the colour photographic recording material used in the process according to the invention contains several, i.e. generally three associations of dye releasing compound with silver halide sensitized to different regions of the spectrum. In these arrangements, the absorption range of the dye released from the dye releasing compound preferably coincides substantially with the region of spectral sensitivity of the associated silver halide. The various associations of dye releasing compound with silver halide may be accommodated in various layers of binder in the colour photographic recording material, and these different layers of binder are preferably separated by separating layers consisting of a water-permeable binder, e.g. gelatine. These separating layers mainly have the function of separating the various associations from one another to counteract falsification of the colours. In such a case, the colour photographic recording material used according to the invention may contain, for example, a light-sensitive layer of binder in which the silver halide is predominantly sensitive to red as a result of spectral sensitization, another light-sensitive layer of binder in which the silver halide is predominantly green-sensitive as a result of spectral sensitization and a third light-sensitive layer of binder in which the silver halide is predominantly sensitive to blue either due to its intrinsic sensitivity or as a result of spectral sensitization. The electron donor compounds optionally present in the three light-sensitive layers may be identical or different.

Each of the above mentioned associations of light-sensitive silver halide with substantially light-insensitive silver salt (if present) and dye releasing compound may also be provided in the form of a so-called complex coacervate.

By "complex coacervate" is meant a form of dispersion in which a mixture of the main constituents is enclosed in a common shell of hardened binder. Dispersions of this kind are also known as packet emulsions. They are obtained by complex coacervation.

The term "complex coacervation" is understood to mean the occurrence of two phases when an aqueous solution of a polycationic colloid is mixed with an aqueous solution of a polyanionic colloid to form a concentrated colloid phase (hereinafter referred to as complex coacervate) and a dilute colloid phase (hereinafter referred to as equilibrium solution) as a result of an electric interchange. The complex coacervate is deposited from the equilibrium solution in the form of droplets and appears as a white cloudiness. When complex coacervation occurs in the presence of a solid such as silver halide or fine oil droplets, it is generally assumed that the complex coacervate encloses the solid or droplets inside colloid particles. The result is a dispersion of coacervate particles in which the solid (in the present case the light-sensitive silver halide and, if present, the substantially light-insensitive silver salt) and the oily droplets of a solution of organic constituents (in the present case the dye releasing compound and optionally other auxiliary substances) are enclosed. A hardener is subsequently added for hardening so that the original form of particles is not destroyed in the subsequent stages of preparation of the photographic recording material such as preparation of the casting solution and coating. The dispersion is preferably cooled to a temperature of 25° C. or less, preferably 10° C. or less before it is hardened. A packet emulsion of high quality is thereby obtained.

Methods for the preparation of a packet emulsion in which a colour producing substance is incorporated by complex coacervation are described, for example, in U.S. Pat. No. 3,276,869 and U.S. Pat. No. 3,396,026.

The use of packet emulsions enables several emulsion components differing in their spectral sensitivity, including the corresponding dye releasing compounds, to be combined in a single layer of binder without any loss in the spectral association and consequently without any colour falsification. This is possible because the extent of exposure of a given silver halide particle almost exclusively determines the amount of dye released from that dye releasing compound which is situated in the same coacervate particle (packet) as the silver halide. The use of packet emulsions thus enables a blue-sensitive, a green-sensitive and a red-sensitive silver halide emulsion, optionally together with substantially light-insensitive silver salt, and the spectrally associated dye releasing compound to be all present in the same layer of binder without any risk of serious colour falsification.

In addition to the components already mentioned above, the colour photographic recording material used in the process according to the invention may contain other components and auxiliary substances which may be useful, for example, for the heat treatment and resulting colour transfer. These additional components or auxiliary substances may be contained in a light-sensitive layer or in a light-insensitive layer or, as already mentioned above, they may be partly or completely contained in the auxiliary sheet used according to the invention.

Auxiliary substances of this kind include, for example, auxiliary developers, which generally have developing properties for exposed silver halide. In the present case, they primarily promote the reactions between the exposed silver salt (silver salt in the presence of exposed silver halide) and the reducing agent, the said reducing agent being identical to the dye releasing compound if the latter is oxidizable but reacting with the dye releasing compound when the latter is reducible. Since these reactions consist mainly of a transfer of electrons, the auxiliary developers are also referred to as electron transfer agents (ETA).

Examples of suitable auxiliary developers include hydroquinone, pyrocatechol, pyrogallol, hydroxylamine, ascorbic acid, 1-phenyl-3-pyrazolinone and derivatives thereof. Since the auxiliary developers are catalytic in their activity, they need not be present in stoichiometric quantities. It is generally sufficient if they are present in the layer in quantities of up to ½ mol per mol of dye releasing compound. They may be incorporated in the layer from solutions in water-soluble solvents, for example, or in the form of aqueous dispersions obtained by means of oil formers.

The auxiliary substances used may also include, for example, basic substances or compounds capable of producing basic substances under the influence of the heat treatment. These include, for example, sodium hydroxide, potassium hydroxide, calcium hydroxide, sodium carbonate, sodium acetate and organic bases, in particular amines such as trialkylamines, hydroxyalkylamines, piperidine, morpholine, dialkylaniline, p-toluidine, 2-picoline, guanidine and salts thereof, in particular salts obtained with aliphatic carboxylic acids. The presence of these basic substances provides a suitable medium in the light-sensitive layer and adjacent layers during the heat treatment to ensure that the diffusible dyes will be liberated from the dye releasing compounds and diffuse into the image receptor layer.

In the colour photographic recording material used according to the invention, an opaque, light-reflecting layer permeable to alkalies and to the thermal development and diffusion promoting agent according to the invention is advantageously arranged between the image receptor layer and the light-sensitive layers. This opaque, light-reflecting layer mainly serves as a covering by which the (negative) colour image formed and left behind in the light-sensitive part in the process of development is shielded from the viewer and at the same time it provides an aesthetically pleasing background for the positive colour image produced in the image receptor layer. This light-reflective layer may be formed in known manner by a layer of binder containing a light pigment, in particular a white pigment such as $TiO_2$. It goes without saying that in such an arrangement the layer support of the recording material must be transparent.

If, on the other hand, the light-sensitive part is removed from the image receptor layer by means of a suitable stripping layer after heat development has been completed, it is unnecessary to provide such an opaque, light-reflecting intermediate layer, and the layer support of the material need not necessarily be transparent.

According to the invention, development of the colour photographic recording material after imagewise exposure is initiated by subjecting the material in contact with the auxiliary sheet according to the invention to a heat treatment in which the layers are heated to a temperature e.g. in the region of 80°°to 250° C. for about 0.5 to 300 seconds. This treatment releases the thermal development and diffusion promoting agents in the auxiliary sheet so that they are transferred to the layers of the recording material, where they create suitable conditions for the development processes including dye diffusion without the use of a liquid medium, e.g. in the form of a developer bath. In the process of development, diffusible dyes are released imagewise from the dye releasing compounds and transferred to the image receptor layer which is an integral part of the colour photographic recording material.

Imagewise development of silver, release of dye and colour transfer thus take place synchronously in a one-step development process.

The auxiliary sheet may be left in contact with the recording material after development or it may be separated. The colour transfer image is visible through the transparent layer support.

EXAMPLE 1

Polystyrene capsules containing glycerol/water (B 1:1)

200 ml of water were mixed with 250 ml of glycerol and 50 ml of a 10% aqueous gelatin solution. Half this mixture was added in the course of 5 minutes with vigorous stirring to 200 ml of a 10% solution heated to 30° C. of polystyrene in chloroform. Stirring was then continued for about 5 minutes until droplets measuring about 5 μm were obtained. The other half of the said mixture was added all at once. The chloroform was evaporated off by heating to 75° C. to 80° C. with continued stirring. The capsule suspension obtained was cooled to 30° C. to 35° C., suction filtered and washed with 300 ml of glycerol/water (1:1).

Yield: 40 g of polystyrene capsules containing about 20 g of glycerol/water (1:1).

EXAMPLE 2

Auxiliary Sheet 250 g of an emulsion of 1000 g of 5% aqueous gelatine, 8 g of a 75% paste of sodium dodecylbenzene sulphonate, 100 g of paladinol and 3.5 g of phenol were melted and mixed with 40 g of polystyrene capsules from Example 1 and 30 g of sodium benzotriazole and the mixture was homogenized by means of a high speed mixer and then degasified. The casting solution was applied to a layer support of polyethylene terephthalate (thickness of wet layer 100 μm), covered with gelatine (1 g/m$^2$) and hardened.

EXAMPLE 3

Preparation of the silver salt emulsions

Emulsion 1

17.0 g of $AgNO_3$ dissolved in 100 ml of water at 45° C. were added with stirring in the course of 2 minutes to a solution heated to 45° C. of 20.0 g of gelatine in 1000 ml of water containing 13.0 g of benzotriazole (BTA). Stirring was then continued for 5 minutes. A solution of 1.0 g of KBr and 0.66 kg of KI in 100 ml of water heated to 45° C. was added in the course of 5 minutes. The pH was adjusted to 5.0 with 5% $Na_2CO_3$ solution. The mixture was flocculated by the addition of 20 ml of a 10% polystyrene sulphonic acid solution, cooling to 25° C. and addition of 10% sulphuric acid (to pH 3.0–3.5) and then washed three times with 1000 ml portions of water. The flocculate was heated to 45° C. and adjusted to pH 6.0 with 5% $Na_2CO_3$ solution. 5 ml of a 1% aqueous phenol solution were added and a further quantity was then added to make the weight up to 500 g.

Emulsion 2

Preparation as for Emulsion 1 except that no KBr/KI solution was used. Final weight 435 g.

Emulsion 3

34.0 g of $AgNO_3$ dissolved in 200 ml of water were added within 10 minutes to a solution heated to 50° C. of 40.0 g of gelatine, 23.7 g of KBr and 1.66 g of KI. The mixture was then stirred for a further 20 minutes at 50° C. and cooled to 35° C. 40 ml of a 10% polystyrene sulphonic acid solution were added dropwise and the mixture was then cooled to 20° C. The mixture was flocculated by the addition of 10% sulphuric acid (to pH 3.0–3.5) and washed three times with 700 ml portions of water. The flocculate was then heated to 40° C.

and adjusted to pH 6.0 with 10% sodium hydroxide solution. Final weight 1171 g.

EXAMPLE 4

Preparation of the dispersions

Dispersion 1 (Dye releasing compound cyan)

50 g of dye releasing compound 7 (cyan) were dissolved in a mixture of 40 g of tricresyl phosphate and 35 g of palmitic acid diethylamide and dispersed in 1260 g of a 6% aqueous gelatine solution in the presence of 2.6 g of sodium dodecylbenzene sulphonate.

Dispersion 2 (Dye releasing compound magenta)

50 g of dye releasing compound 10 (magenta) were dissolved in a mixture of 64 g of tricresyl phosphate and 21 g of diethyl laurylamide and dispersed in 833 g of a 6% aqueous gelatine solution in the presence of 1.7 g of sodium dodecylbenzene sulphonate.

Dispersion 3 (dye releasing compound yellow)

50 g of dye releasing compound 11 (yellow) were dissolved in a mixture of 47 g of tricresyl phosphate and 46 g of palmitic acid diethylamide and dispersed in 1280 g of a 6% aqueous gelatine solution in the presence of 3.0 g of sodium dodecylbenzene sulphonate.

Dispersion 4 (electron donor compound)

50 g of compound ED-1 (electron donor compound) were dissolved in 50 g of palmitic acid diethylamide and dispersed in 540 g of a 10% aqueous gelatine solution in the presence of 0.1 g of sodium dodecylbenzene sulphonate.

Dispersion 5 (auxiliary developer)

100 g of the compound corresponding to the formula below were dissolved in 200 g of of diethyllauramide and dispersed in 1000 g of a 10% aqueous gelatine solution with the addition of 4.7 g of a 75% paste of sodium dodecyl benzene sulphonate.

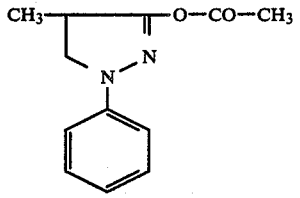

EXAMPLE 5

Preparation of the packet emulsions

PE-1 (cyan)

34.4 g of Emulsion 3 were melted at 40° C., spectrally sensitized by the addition of a 0.1% methanolic solution of a red sensitizer in a quantity of $8\times10^{-4}$ mol per mol of silver halide, and left to digest for 70 minutes at 40° C. 25.6 g of Emulsion 2 and 35 ml of water heated to 40° C. were added. 44.8 g of Dispersion 1 (cyan) and 11.2 g of Dispersion 4 were then added.

55 ml of a 10% gum arabic solution were subsequently added and the mixture was stirred for 15 minutes, whereupon 140 ml of water at 40° C. were added dropwise in the course of 4 minutes. The pH was adjusted to 4.8 by the slow addition of 1% acetic acid and the mixture was stirred for a further 15 minutes. It was then rapidly cooled to about 8° C. with continued stirring and a solution of 0.55 g of chrome alum in 160 ml of water was added in the course of 4 minutes. Stirring was continued for 1 to 1½ hours at 8° C. After centrifuging and removal of the supernatant liquid, 49 g of PE-1 (cyan) having an average particle size of about 7 μm were obtained.

PE-2 (magenta)

PE-2 was prepared by a method analogous to that described for PE-1 but with the following differences:

Green sensitizer ($8\times10^{-4}$ mol per mol of silver halide) instead of red sensitizer 24.3 g of Dispersion 2 (magenta) instead of Dispersion 1.

After separation by centrifuging, 41 g of PE-2 (magenta) having an average particle size of about 10 μm were obtained.

PE-3 (yellow)

PE-3 was prepared by a method analogous to that described for PE-1 but with the following differences:

Blue sensitizer ($8\times10^{-4}$ mol per mol of silver halide) instead of red sensitizer, 32.2 g of Dispersion 3 (yellow) instead of Dispersion 1.

55 g of PE-3 (yellow) having an average particle size of about 5 μm were obtained after separation by centrifuging.

PE-4 (cyan)

PE-4 was prepared by a method analogous to that described for PE-1 but with the following difference:

59 g of Emulsion 1 were used instead of the mixture of Emulsions 2 and 3.

Yield: 45 g.

PE-5 (magenta)

PE-5 was prepared by a method analogous to that described for PE-2 but 59 g of Emulsion 1 were used instead of the mixture of Emulsions 2 and 3.

Yield: 39 g.

PE-6 (yellow)

PE-6 was prepared by a method analogous to that described for PE-3 but 59 g of Emulsion 1 were used instead of a mixture of Emulsions 2 and 3.

Yield: 51 g.

PE-7 (cyan)

PE-7 was prepared by a method analogous to that described for PE-1.but 68.9 g of Emulsion 3 were used instead of the mixture of Emulsions 2 and 3.

PE-8 (magenta)

PE-8 was prepared by a method analogous to that described for PE-2 but 68.9 g of Emulsion 3 were used instead of the mixture of Emulsions 2 and 3.

Yield: 43 g.

PE-9 (yellow)

PE-9 was prepared by a method analogous to that described for PE-3 but 68.9 g of Emulsion 3 were used instead of the mixture of Emulsions 2 and 3.

Yield: 53 g.

The following spectral sensitizers were used:

Red sensitizer:

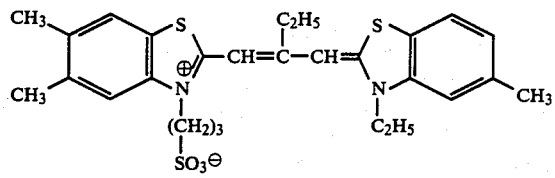

Green sensitizer:

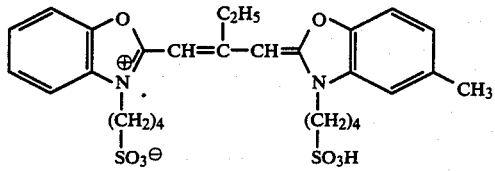

Blue sensitizer:

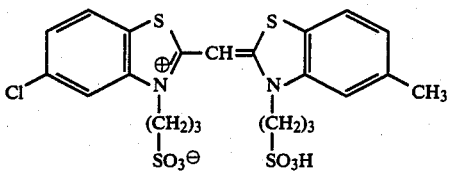

EXAMPLE 6

The image receptor part of a photographic recording material for the dye diffusion transfer process was prepared by applying the following layers in succession to a transparent layer support of polyethylene terephthalate. The quantities are based in each case on 1 $m^2$.

1. A mordanting layer containing 2 g of polyurethane mordant obtained from 4,4'-diphenylmethane diisocyanate and N-ethyl-diethanolamine quaternised with epichlorohydrin according to DE-A-No. 2,631,521, Example 1, and 2 g of gelatine.
2. A light-reflecting layer containing 13 g of $TiO_2$ and 1.3 g of gelatine.
3. A protective layer containing 1 g of gelatine.

The image receptor material obtained served as coating support in the following Examples for the preparation of integral recording materials.

EXAMPLE 7

A photographic recording material (Material 1) was prepared as described below, using the coating support described in Example 6 (image receptor part) containing layers 1, 2 and 3.

34.4 g of Emulsion 3 were melted at 40° C. and spectrally sensitized by the addition of a 0.1% methanolic solution of red sensitizer (Example 5) in a quantity of $8\times10^{-4}$ mol per mol of silver halide, and digested for 70 minutes at 40° C. 25.6 g of Emulsion 2 and 35 ml of warm water were then added. 44.8 g of Dispersion 1, 11.2 g of Dispersion 4, 40 ml of a 10% aqueous solution of guanidine trichloroacetate, 4 ml of wetting agent Triton $X^{[R]}$, 4% (alkylarylpolyether alcohol; Manufacturers Rohm and Haas Company, Philadelphia), 18.4 g of Dispersion 5 (auxiliary developer) and a solution of 19 g of gelatine in 170 ml of water were also added. The casting solution obtained was applied as fourth layer to the coating support described above and had a layer thickness when wet of 100 μm. After it had dried, a protective gelatine layer was applied as fifth layer in a thickness corresponding to 1 g/$m^2$.

After drying, Material 1 prepared as described above was exposed to red light behind a grey wedge and then laminated with the auxiliary sheet described in Example 2 and uniformly heated to 110° C. for 4 minutes. A cyan transfer image having a minimum density (Dmin) of 0.78 and maximum density (Dmax) of 1.20 visible through the transparent layer support was produced in the image receptor layer. When Material 1 was stored at room temperature for 4 weeks before exposure, the Dmin and Dmax values obtained were virtually unchanged (0.81 and 1.24, respectively).

EXAMPLE 8

Photographic recording materials (Materials 2 to 10) were prepared as described below using the coating support described in Example 6 comprising layers 1,2 and 3 and the packet emulsions described in Example 5.

A casting solution prepared from one of the packet emulsions PE-1 to PE-9 described in Example 5 by homogenizing the packet emulsion with 100 ml of water for 10 minutes and adding 40 ml of a 10% guanidine trichloroacetate acetate solution, 4 ml of wetting agent Triton $X^{8\,R]}$, 4%, 18.4 g of Dispersion 5 (auxiliary developer) and a solution of 19 g of gelatine in 170 ml of water was applied as fourth layer. The resulting casting solutions applied in each case as fourth layer had a layer thickness when wet of 100 μm. In Materials 8, 9 and 10, the casting solutions in addition contained 64 mg of 1-phenyl-5-mercaptotetrazole in methanolic solution per 100 g of $AgNO_3$.

A protective gelatine layer (1 g/$m^2$) was applied as fifth layer and the material was then hardened and dried.

One sample from each of Materials 2 to 10 prepared as described above was exposed to red, green or blue light behind a grey wedge through a filter corresponding to the particular spectral sensitization. Subsequent processing (heat treatment) was carried out as described in Example 7. Colour wedges visible through the transparent layer support and having the Dmin and Dmax values shown in Table 1 were obtained. One further sample from each of the Materials 2 to 10 was stored at room temperature for 4 weeks before being exposed and processed. The values obtained from these samples are shown in brackets in Table 1.

TABLE 1

| | | | Dmin | | Dmax | |
|---|---|---|---|---|---|---|
| Material | Packet emulsion | Colour | fresh | (after storage) | fresh | (after storage) |
| 2 | PE-1 | cyan | 0.25 | (0.27) | 1.15 | (1.19) |
| 3 | PE-2 | magenta | 0.16 | (0.19) | 1.05 | (1.10) |
| 4 | PE-3 | yellow | 0.22 | (0.25) | 1.08 | (1.15) |
| 5 | PE-4 | cyan | 0.20 | (0.24) | 1.09 | (1.16) |
| 6 | PE-5 | magenta | 0.14 | (0.17) | 0.94 | (1.05) |
| 7 | PE-6 | yellow | 0.18 | (0.21) | 0.98 | (1.07) |
| 8 | PE-7 | cyan | 0.27 | (0.31) | 1.20 | (1.24) |
| 9 | PE-8 | magenta | 0.19 | (0.24) | 1.13 | (1.19) |

TABLE 1-continued

| Material | Packet emulsion | Colour | Dmin fresh | Dmin (after storage) | Dmax fresh | Dmax (after storage) |
|---|---|---|---|---|---|---|
| 10 | PE-9 | yellow | 0.24 | (0.28) | 1.05 | (1.12) |

Table 1 shows a suitable ratio of Dmin to Dmax regardless of the special type of emulsion chosen. The Dmin and Dmax values were only slightly raised after 4 weeks' storage.

EXAMPLE 9

The following additional layers were applied successively to the coating support comprising layers 1, 2 and 3 described in Example 6 (Material 11):

4th Layer: Mixture of the casting solutions described in Example 6 for the fourth layer of Materials 2 and 3 containing packet emulsions PE-1 and PE-2, wet application 200 μm.

5th Layer: Yellow filter layer containing 1 g of gelatine per $m^2$ and a yellow filter dye; density about 2.0.

6th Layer: The casting solution for the fourth layer of Material 4 described in Example 6 containing packet emulsion PE-3, wet application 100 μm.

7th Layer: Protective layer containing 1 g of gelatine per $m^2$.

8th Layer: Hardening layer.

EXAMPLE 10

The following additional layers were applied to the coating support used in Example 6 (Material 12):

4th Layer: Mixture of the casting solution described in Example 8 for the fourth layer of Materials 2, 3 and 4 containing packet emulsions PE-1, PE-2 and PE-3, wet application 300 μm.

5th Layer: Protective layer containing 1 g of gelatine per $m^2$.

6th Layer: Hardening layer.

EXAMPLE 11

The photographic recording materials described in Examples 9 and 10 were exposed to red, green and blue light through a combination filter and subjected to the heat treatment described in Example 5. The results obtained are shown in Table 2.

TABLE 2

| Material | Dmax Cyan | Dmax Magenta | Dmax Yellow |
|---|---|---|---|
| 11 | 1.02 | 0.97 | 0.78 |
| 12 | 0.98 | 0.93 | 0.89 |

In Material 12, all three colours achieved approximately the same high maximum density. In Material 11, the yellow density was slightly less due to the longer path of diffusion but this can be compensated for to a certain extent by increasing the wet applications of the particular packet emulsion.

EXAMPLE 12

When the photographic recording materials described in Examples 7, 8, 9 and 10 were exposed to red, green and blue light through a combination filter and subjected to the heat treatment described in Example 7 but in the absence of the auxiliary sheet according to the invention, no colour transfer was obtained. This state of development and colour transfer corresponds, based on the quantity of water available, to the state of equilibrium of the residual moisture content of the recording material with its surroundings.

We claim:

1. In a heat development process for the production of colour images in which an imagewise exposed colour photographic recording material consisting of a laminate arranged on a layer support and composed of at least one image receptor layer absorbent to diffusible dyes and at least one layer of binder containing light-sensitive silver halide, optionally in combination with a substantially light-insensitive silver salt, and having associated with it a non-diffusible colour providing compound capable of releasing a diffusible dye as a result of development, is developed by heat treatment in the presence of a thermal development and diffusion promoting agent, the improvement according to which the heat treatment is carried out while the colour photographic recording material is in flat contact on its coated side with an auxiliary sheet placed thereon, said auxiliary sheet having microcapsules of a polymeric organic material dispersed in a layer of binder, said microcapsules containing, enclosed therein, a thermal development and diffusion promoting agent which is liquid at room temperature.

2. The heat development process as claimed in claim 1, wherein the thermal development and diffusion promoting agent is water, ethylene glycol, propylene glycol, butylene glycol or glycerol or mixtures thereof.

3. The heat development process as claimed in claim 1, wherein the polymeric organic material of the microcapsules is polystyrene.

4. The heat development process as claimed in claim 1 wherein the colour photographic recording material contains in the following sequence on a transparent layer support, an image receptor layer, an opaque, light-reflecting layer and one or more layers of binder with light-sensitive silver halide contained therein and associated colour providing compounds.

* * * * *